US008752492B1

(12) United States Patent
Harris

(10) Patent No.: US 8,752,492 B1
(45) Date of Patent: Jun. 17, 2014

(54) PADDLE BOARD WITH REMOVABLE SEAT

(76) Inventor: David R. Harris, El Granada, CA (US)

( * ) Notice: Subject to any disclaimer, the term of this patent is extended or adjusted under 35 U.S.C. 154(b) by 5 days.

(21) Appl. No.: 13/532,702

(22) Filed: Jun. 25, 2012

Related U.S. Application Data

(60) Provisional application No. 61/599,812, filed on Feb. 16, 2012.

(51) Int. Cl.
*B63B 1/00* (2006.01)

(52) U.S. Cl.
USPC ..... 114/61.1; 441/65; 441/79

(58) Field of Classification Search
USPC ..... 114/347, 61.1, 61.14, 61.23; 441/65, 79
See application file for complete search history.

(56) References Cited

U.S. PATENT DOCUMENTS

| | | | | |
|---|---|---|---|---|
| 3,103,673 | A * | 9/1963 | Martin, Jr. | 441/68 |
| 4,925,417 | A * | 5/1990 | Warren | 441/65 |
| 6,736,083 | B2 * | 5/2004 | Frederick | 114/347 |
| 6,871,608 | B2 * | 3/2005 | Rosen | 114/61.1 |
| 7,461,612 | B1 * | 12/2008 | Houck | 114/347 |
| 2004/0255836 | A1 * | 12/2004 | Hopkins | 114/347 |

* cited by examiner

*Primary Examiner* — Stephen Avila
(74) *Attorney, Agent, or Firm* — Ray K. Shahani, Esq.; Kin Hung Lai

(57) ABSTRACT

A twin-hull paddle board for use while standing or sitting down, the twin-hull paddle board consists of two elongated hulls, a flat platform portion having two side edges, a front edge and a back edge, the platform portion connected across the top of the two hulls intermediate between the front ends and the back ends of each hull, the flat platform portion and the tops of the hulls forming an upper deck portion, the upper deck portion comprising two recessed foot wells placed adjacent to the side edges of the flat platform portion, the recessed foot wells contoured to prevent accumulation or puddling of water during use, and a coupling mechanism for removably coupling the leg portion of the removable seat to the upper deck portion of the paddle board.

12 Claims, 15 Drawing Sheets

PADDLE BOARD WITH REMOVABLE SEAT

RELATED APPLICATIONS

This Application is a Nonprovisional Patent Application related to U.S. Provisional Patent Application Ser. No. 61/599,812 filed Feb. 16, 2012 entitled "REMOVABLE SEAT FOR STAND UP PADDLE BOARDS", which is incorporated herein by reference in its entirety, and claims any and all benefits to which it is entitled therefrom.

FIELD OF THE INVENTION

The present invention relates to an improved stand up paddle board, and more particularly, to a twin-hull style stand up paddle board with a removable seat to allow users to optionally, stand, sit and/or squat down while paddling.

BACKGROUND OF THE INVENTION

Stand up paddle [a.k.a. SUP] boarding is currently one of the world's fastest growing sports and fast becoming one of the worlds most popular sports. The leading manufacturers of SUPs are mainly producing surfboard design paddle boards. These designs are great for people who enjoy stand up paddle surfing on ocean swells and waves. However, surfboard style paddle boards usually lack lateral stability and are easy to topple, especially with inexperienced paddle boarders.

After long periods of paddling riders can become fatigued. Paddling while standing can also be a problem for people with physical disabilities or problems such as sore feet or weak legs. People using conventional paddle boards have no way to sit and paddle the boards.

U.S. Pat. No. 22,457 to Rowlands and U.S. Pat. No. 6,871,608 to Rosen both disclose double-hull water craft. However, the prior art fails to teach or anticipate a twin-hull, stand-up paddle board having recessed foot wells and an optional, removable seat portion.

ADVANTAGES AND SUMMARY OF INVENTION

An object and advantage of the present invention is to provide lateral stability with the twin-hull style structure of the board.

Another object and advantage of the present invention is to provide a deep-V bow structure for increased stability, particularly in the presence of waves, splashing, choppy water, wake from other water craft or the like.

Another object and advantage of the present invention is to provide recessed foot wells for lowering the center of gravity of a user, thereby increasing stability while standing upright or kneeling on the SUP of the present invention.

Another object and advantage of the present invention is to provide an option to incorporate a removable seat on a conventional paddle board. The optional seat can be deployed for users to take a momentary, periodic or permanent break from standing up on the SUP board.

Yet another object and advantage of the present invention is to provide users an option to sit down and paddle the SUP board simultaneously.

Yet another object and advantage of the present invention is to provide a paddle board having a completely sealed upper deck construction wherein there are no ports, cavities, cockpits or other hollow or open areas to collect water or contribute to swamping of the craft in the event water from waves washing over the top of the hulls or from rain enters the openings. This sealed upper deck construction eliminates the problems associated with water entering the cockpit, cavities or other openings in the top of the hull, such as occurs in dinghy-style or other open hull watercraft.

Further details, objects and advantages of the present invention will become apparent through the following descriptions, and will be included and incorporated herein.

For a better understanding of the invention reference is made to the following detailed description of the preferred embodiments thereof which should be taken in conjunction with the prior described drawings.

DETAILED DESCRIPTION OF THE PREFERRED EMBODIMENT

The description that follows is presented to enable one skilled in the art to make and use the present invention, and is provided in the context of a particular application and its requirements. Various modifications to the disclosed embodiments will be apparent to those skilled in the art, and the general principals discussed below may be applied to other embodiments and applications without departing from the scope and spirit of the invention. Therefore, the invention is not intended to be limited to the embodiments disclosed, but the invention is to be given the largest possible scope which is consistent with the principals and features described herein.

For a better understanding of the invention reference is made to the following detailed description of the preferred embodiments thereof which should be taken in conjunction with the prior described drawings.

Figure 1:
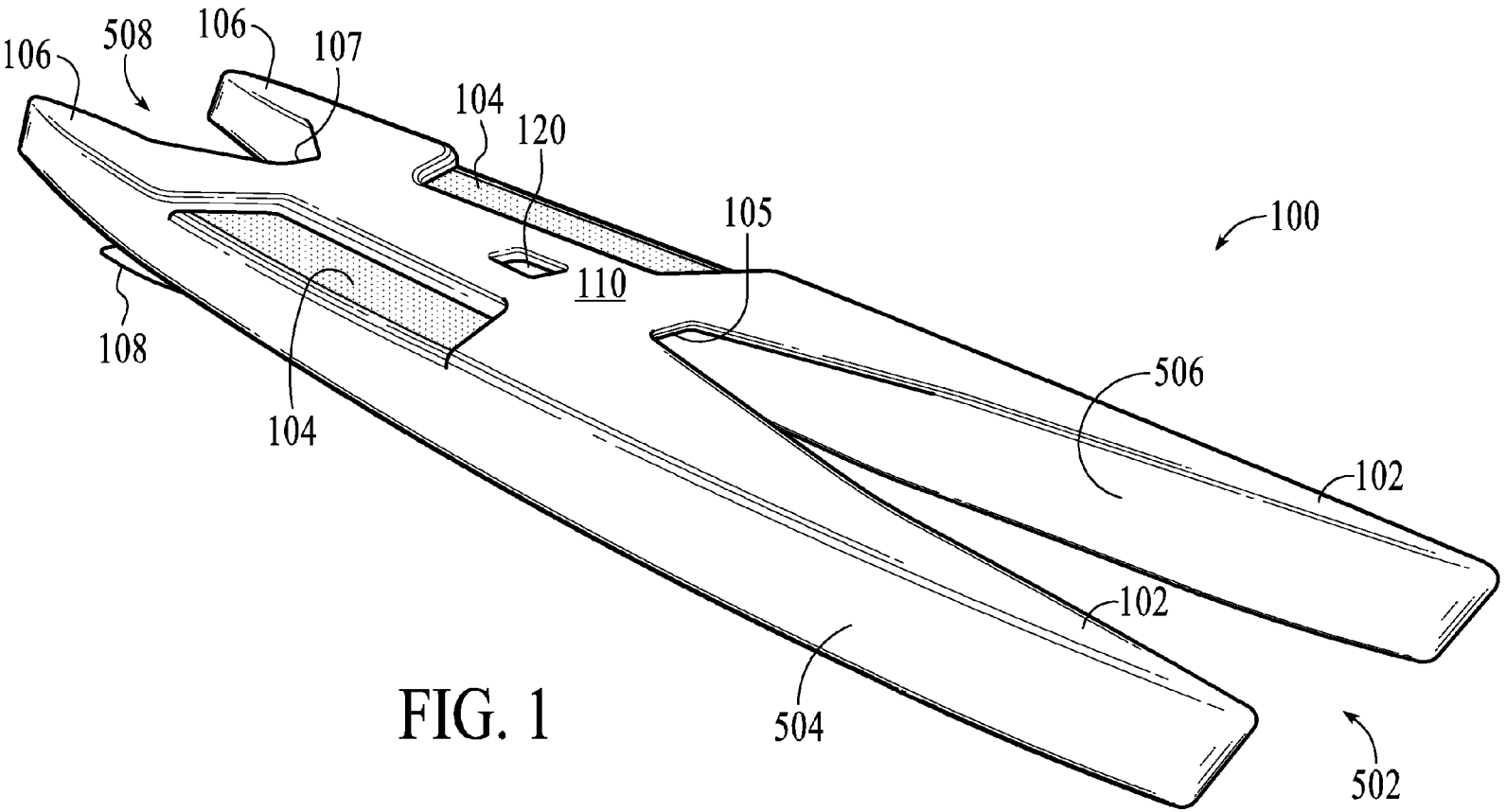
FIG. 1 is a representative upper isometric view of the paddle board 100 of the present invention.
Figure 2:
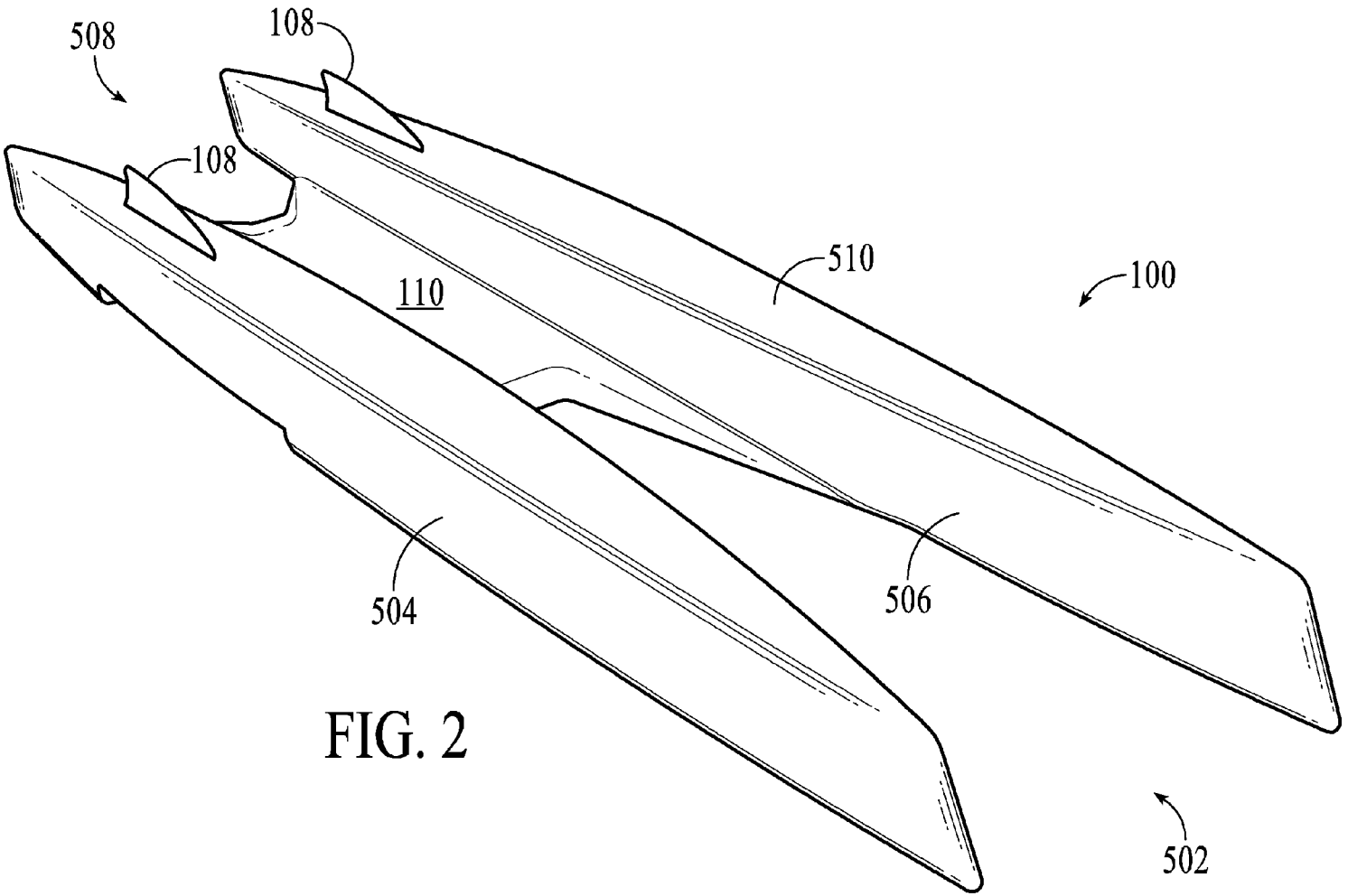
FIG. 2 is a representative lower isometric view of the paddle board 100 of the present invention.

FIG. 1 is a representative upper isometric view of the paddle board 100 of the present invention. FIG. 2 is a representative lower isometric view of the paddle board 100 of the present invention. As shown in FIGS. 1 and 2, the paddle board is structurally different from surfboard or other style paddle boards. In one embodiment, the paddle board 100 of the present invention has a twin-hull style structure which consists of two essentially identical hulls 102 joined by deck 110. An advantage of the twin-hull style is that the narrow pointed deep V-shaped bows 105 cut through wind, chop, waves and swells with ease rather than bouncing around on top of them as would a traditional style SUP board.

In one embodiment, the paddle board 100 of the present invention could be made out of any types of suitable marine compatible materials, including but not limited to, fiberglass over foam, hollow core fiberglass, roto-molded plastics, aluminum etc. One preferred building material is fiberglass or carbon fiber over a foam core. In one embodiment, the hulls 102 are elongated pontoons which have a streamlined shape, and further consists a outward side panel 504 and inward side panel 506, to provide the main buoyance of the entire paddle board 100. Upper deck 110 is an essentially flat or slightly curved or arched top structure made of sturdy but lightweight material to support the weight of a paddler. As shown in FIG. 1, there are front end 502 and rear end 508 of SUP board 100 of the present invention. The cross-sectional profile taken side-to-side of the upper deck 110 can either be flat or slightly curved, rounded or broadly V-shaped. It will be understood that while an essentially flat or slightly curved upper deck 110 would be advantageous or preferred for sitting, lying, sunbathing or transporting passengers, pets, food, supplies or other equipment or objects, a more rounded or even slightly "V"-shaped upper deck 110, which increases the clearance between the lower surface of the deck portion and the water, might be considered advantageous by some boaters for reducing water or wind resistance, etc.

As best shown in FIG. 1, the connections 105 and 107 among the two hulls 102 and upper deck 110 form a deep "V" shape. The "V" shape opening 105 in front is in the reverse direction as the "V" shape opening 107 in the rear, and the "V" shape opening 107 in the rear is optionally shorter than the deep "V" trench 105 located in the front of the board 100. One of the major problems of using a surfboard design paddle board is the lack of lateral stability. As shown in FIG. 1, by using a twin-hull style paddle board 100, the lateral stability can be increased by 50 to 100% or more over the traditional surfboard design.

As best shown in FIG. 1, top deck 110 further consists of two foot wells 104 located on both sides of deck 110. In one embodiment, foot wells 104 are recessed portions mainly for paddlers to put their feet on and also make center of gravity of paddlers lower to the water level. The surface of foot wells 104 are optionally made non-slippery to enhance safety for paddlers. The depth of foot wells 104 below the top deck 110 can be varied as per design choice. In general, however, the foot wells 104 can be anywhere between about 1 inch or less and about 6 inches or more below the upper deck 110. Any design that prevents puddling or filling with water such as having a slightly contoured surface would be advantageous. As stated above, by lowering the level of the foot wells 104 to below the level of the upper deck 110, the center of gravity for the board 100 and user combined can be lowered, thereby increasing stability of the SUP board 100 of the present invention.

In one embodiment, deck 110 also incorporates an deck opening 120 through the deck 110 at or near the central balance point of the paddle board 100 of the present invention. This deck opening 120 can be in any reasonable shapes such as square, rectangle, circle, oval and other dimensions. One purpose of having deck opening 120 is to enhance ease of carrying by providing a handle. In one embodiment, paddle board 100 is easily carried by placing it under ones' arm while placing a hand through the deck opening 120. Additionally, deck opening 120 along with the twin-hull style of the SUP board 100 are also advantageous for boarding purposes, i.e., climbing back onto the SUP board 100 from in the water. Paddlers, in the event of having fallen off their paddle board 100, can simply swim up in between the hulls 102, reach forward placing a hand through the deck opening 120 and pull themselves onboard.

Field tests have shown having the deck opening 120 much enhanced easiness of boarding from the side as is common with traditional surfboard style boards. In one embodiment, deck opening 120 can also be used as an anchor point for auxiliary equipments, camping gear, coolers, storage containers or even a seat portion 200, which will be explained in details. A bicycle cable lock can be placed through the deck opening 120 and then around other fixed objects such as car top roof racks, bicycle racks, fence posts, utility poles, etc. to prevent theft.

Figure 5:
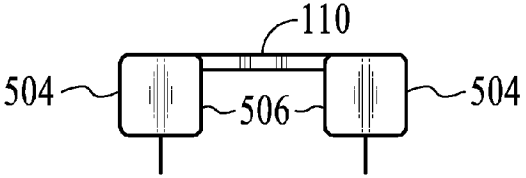
FIGS. 5 and 6 are representative front end and back end views of the paddle board 100 of the present invention.
Figure 6:
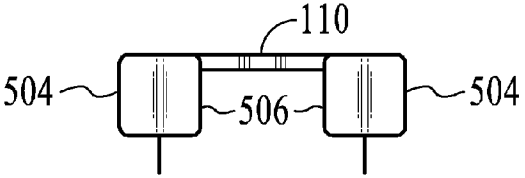

FIGS. 5 and 6 are representative front and end views of the paddle board 100 of the present invention. As best shown in FIGS. 2, 5 and 6, only the upper portion of the two hulls 102 of the paddle board 100 are connected by the flat deck 110. Optionally, each hull 102 further consists of fin 108 near its back portion 106 installed on underside 510 of each hull 102. The main purpose of having deck 110 on top of hulls 102 is to keep a low profile. One necessary aspect of any efficient paddle board is having a low profile relevant to the water surface to reduce the windage that can greatly affect performance. The low profile also keeps the paddler closer to the water surface allowing better leverage on the paddle. In one embodiment, with a twin-hull structure the deck 110 connecting the two separate hulls 102 needs to be above the water. With a low profile this means that the distance between the water surface and the underside of the deck 110 is minimal.

Figure 3:
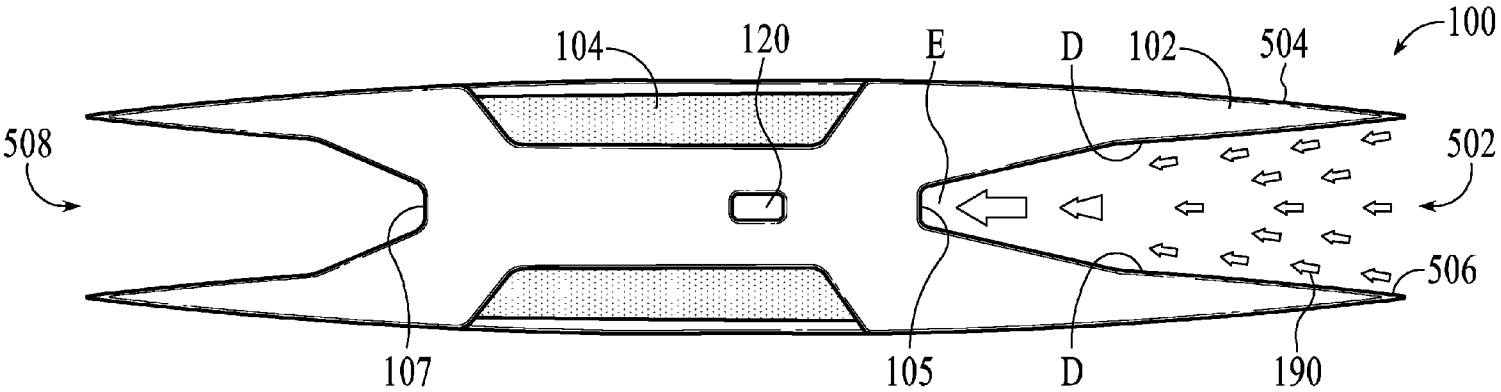
FIGS. 3 and 4 are representative upper and lower views of the paddle board 100 of the present invention.
Figure 4:
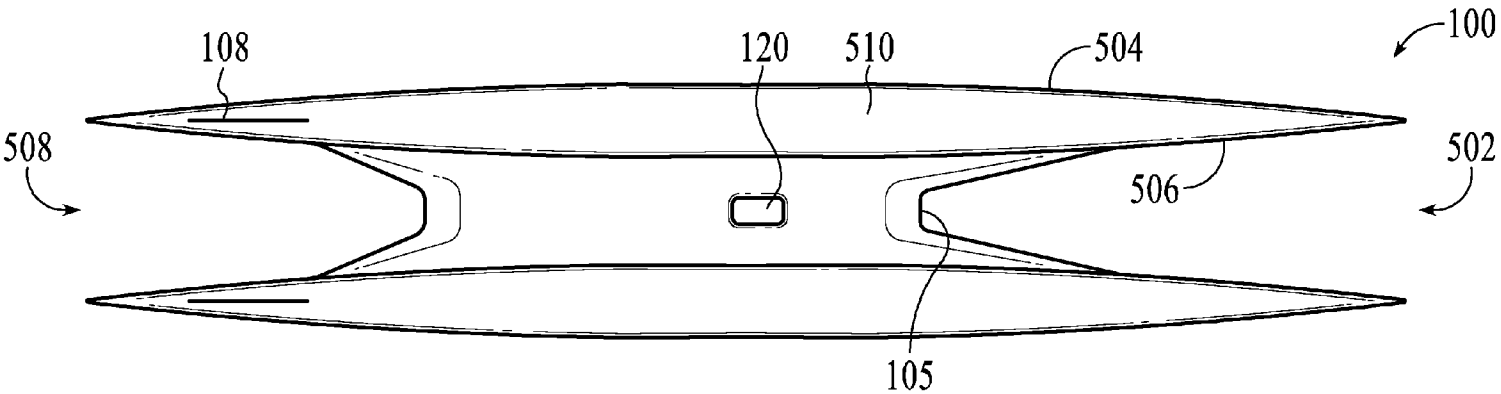

FIGS. 3 and 4 are representative upper and lower views of the paddle board 100 of the present invention. Since the deck 110 of the paddle board 100 of the present invention is designed to be very close to the water surface, one of the main issues is that waves coming under paddle board 100 can strike the underside of the deck 110 causing drag and slowing the entire paddle board 100. This drag can be eliminated by utilizing the deep "V" trench 105 and 107 design of the upper deck 110 area of the SUP 100 of the present invention. Also, in the absence of this deep "V" shape, any wave striking the front of the deck 110 could cause a jolt stalling the paddle board 100, thereby throwing the paddler off balance and even causing him or her to fall off of the paddle board 100 and into the water.

As best shown in FIG. 3, one structural aspect of the paddle board 100 of the present invention is that while in a forward motion, water 190 facing front end 502 of the present invention is being forced between the hulls 102 and compressed inwardly between the two separate hulls 102 causing the paddle board 100 to create a wake 180. This water 190 colliding with itself as it is forced together by the front ends of the twin hulls 102 pushing forward through the water is forced upwards around three to four inches at typical velocities, and as high as six inches or more such as in cases of paddling at higher speed. This wake 180 can also strike the underside of the deck 110 and eventually slow down a conventional paddle board 100. In field tests it has been noted that this wake 180 dissipates after about 1.5 to 2 feet from the point where it was created. In one embodiment, paddle board 100, when in motion, will create wake 180 which may be observed to begin after approximately the first 15% to 25% of the length of the front portion of the paddle board 100 at point D. As best shown in FIGS. 3 and 4, in order to address this issue, the connections 105 and 107 among the two hulls 102 and deck 110 are shaped like a reversed "V" shape. For instance, on a 12 foot test paddle board 100, the created wake 180 typically begins at approximately 2.5 feet from the front end 502 of the hulls 102 of the board 100. After approximately 1.5 feet to 2 feet the wake 180 would dissipate at point E. This structure incorporates a reverse "V" deck connection 105 which solves these problems. The deck 110 is cut away in a V shape allowing paddle board 100 to create wake 180 which dissipates at point E before striking the underside of the deck 110. This also allows waves coming under the board to gently lift paddle board 100 rather than slamming into a forward portion of deck 110 at connection 105. In the example of the paddle board 100 12 feet in length, the reverse "V" would begin at about 2.5 ft. from front tip of each hull 102 and would extend rearward about another 2 feet until they connect with the flat deck 110, forming a reverse "V" shape.

These dimensions are based on a 12 foot prototype test paddle board 100. The paddle board 100 of the present invention itself should not be limited to any specific dimension or dimensions. A similar reversed "V" shape connection 107 is located at the back of the paddle board 100. It performs the similar functions as the front connection 105 from swells, waves, wind waves etc. which are coming from the rearward direction facing rear end 508 of the board 100.

Figure 7:
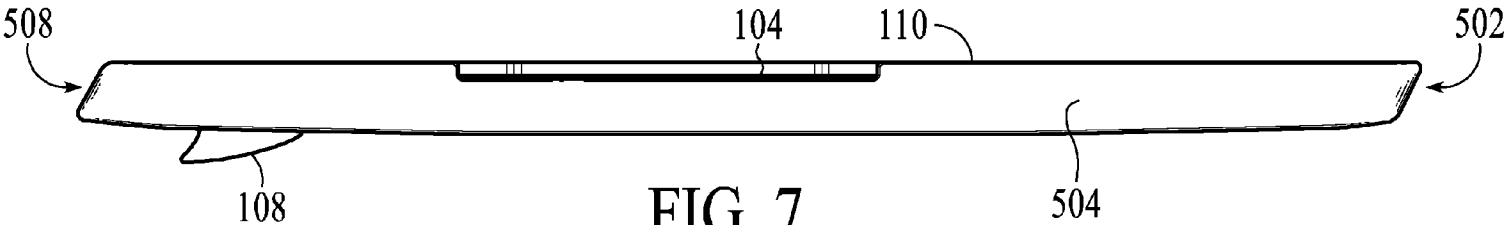
FIGS. 7 and 8 are representative left side and right side views of the paddle board 100 of the present invention.
Figure 8:
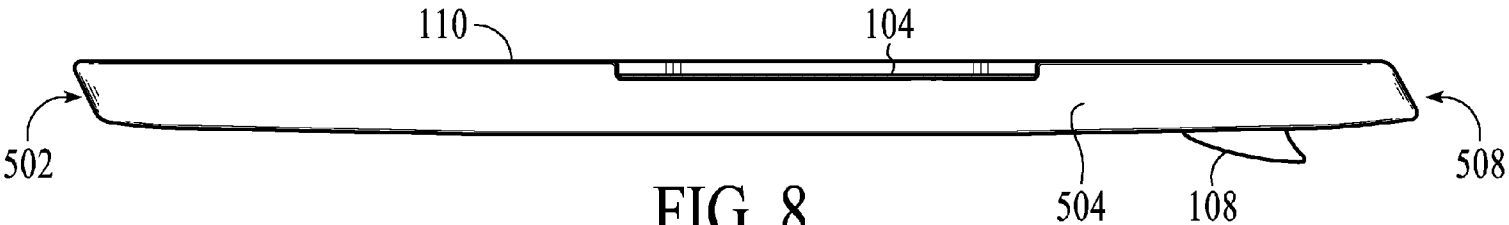

FIGS. 7 and 8 are representative left and right side views of the paddle board 100 of the present invention. In one embodiment, deck 110 should be above water level but remains low profile. Fins 108 are optional accessory which enhance stability of the paddle board 100 of the present invention while in motion.

Figure 9:
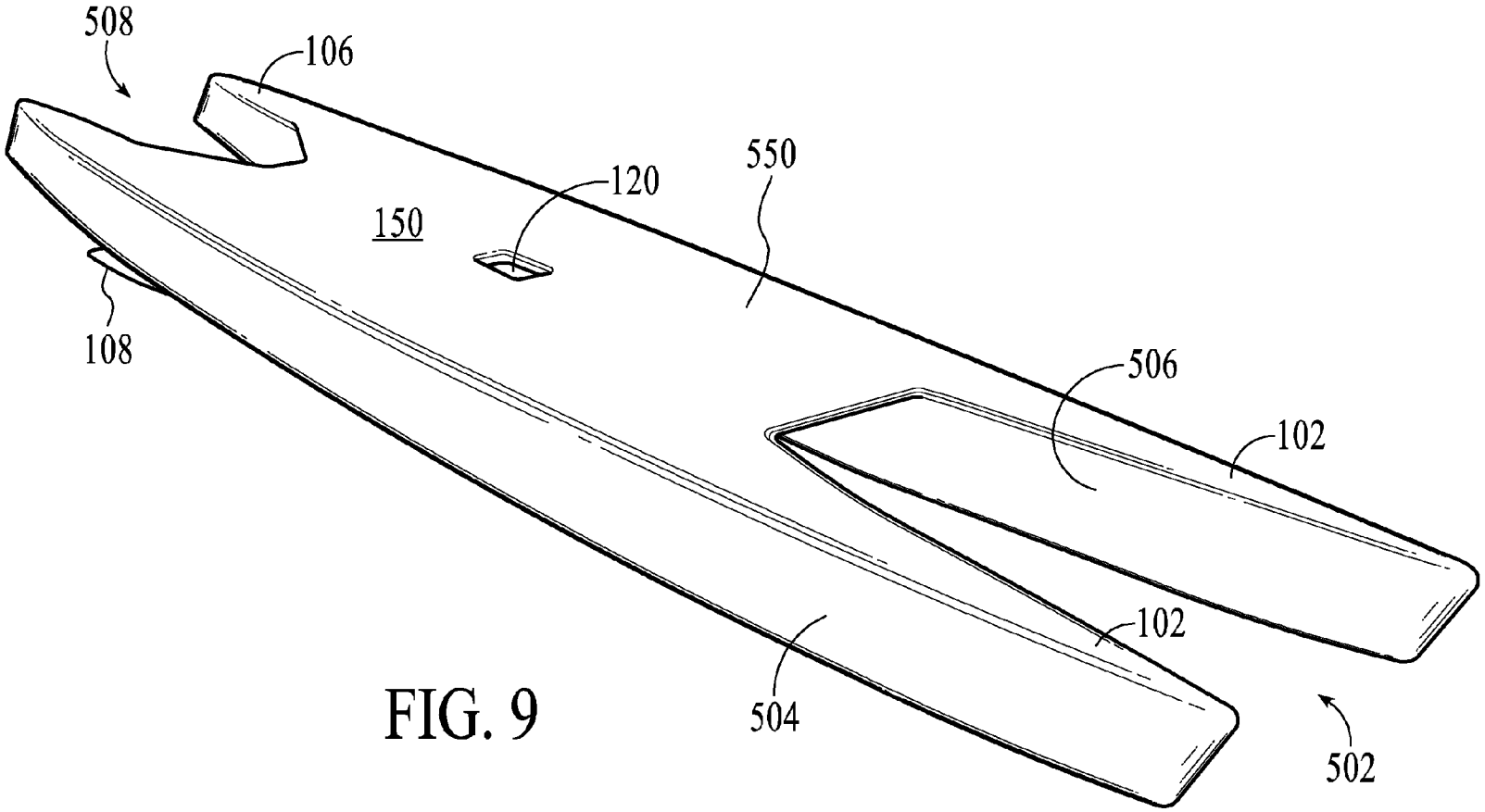
FIGS. 9 and 10 are representative upper and lower isometric views of an alternative embodiment of the paddle board 150 of the present invention.
Figure 10:
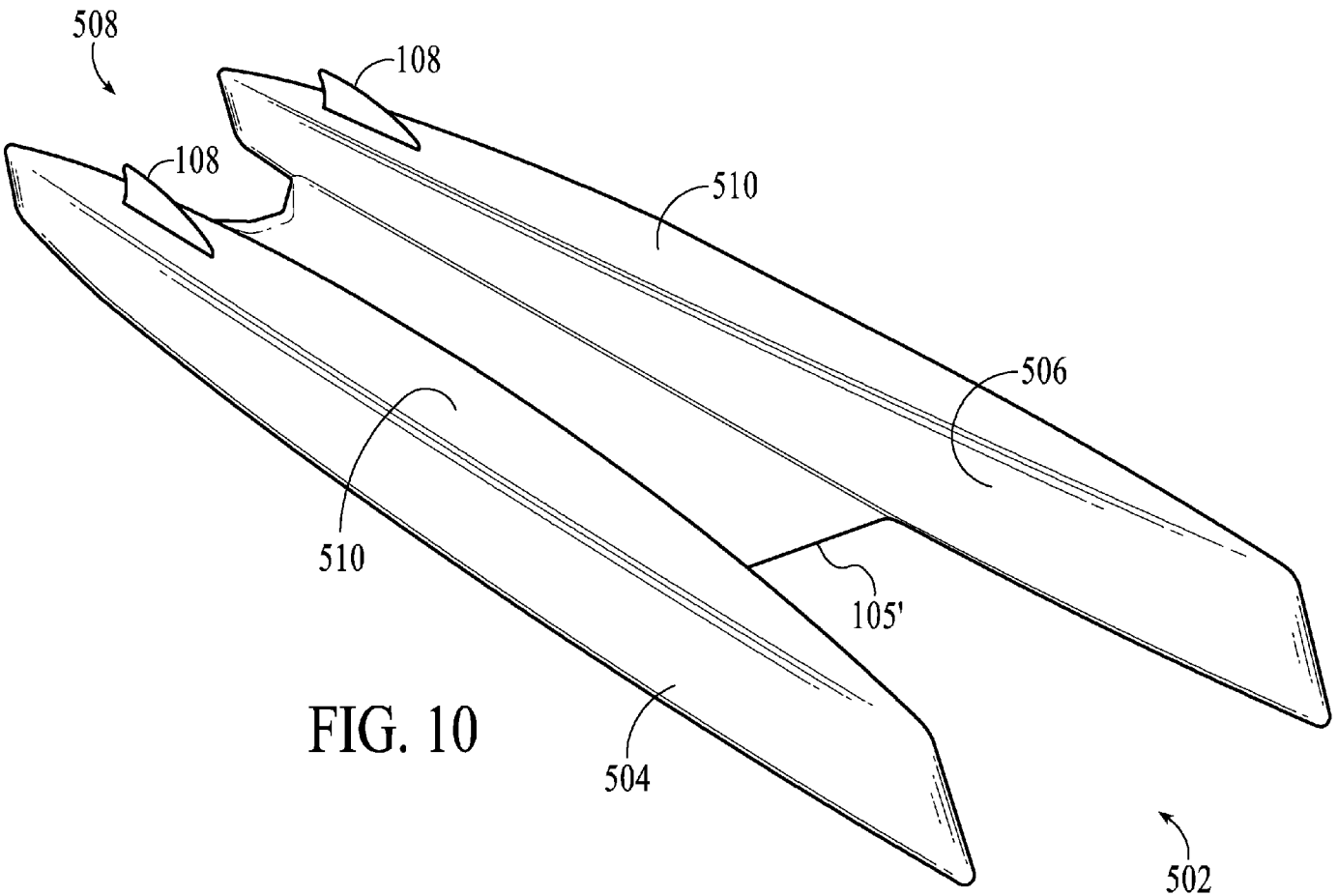

FIGS. 9 and 10 are representative upper and lower isometric views of an alternative embodiment of the paddle board 150 of the present invention. As best shown in FIGS. 9 and 10, the reversed "V" shape of connection 105' is not as prominent when compared to alternate embodiment paddle board 150. In one embodiment, there are no foot wells 104 and deck 110 is much more spacious. The full flush deck 150 allows paddlers freedom of movement and greater choice of foot placement, and plenty of space for pets, passengers, second paddlers or even sunbathing.

Figure 11A:
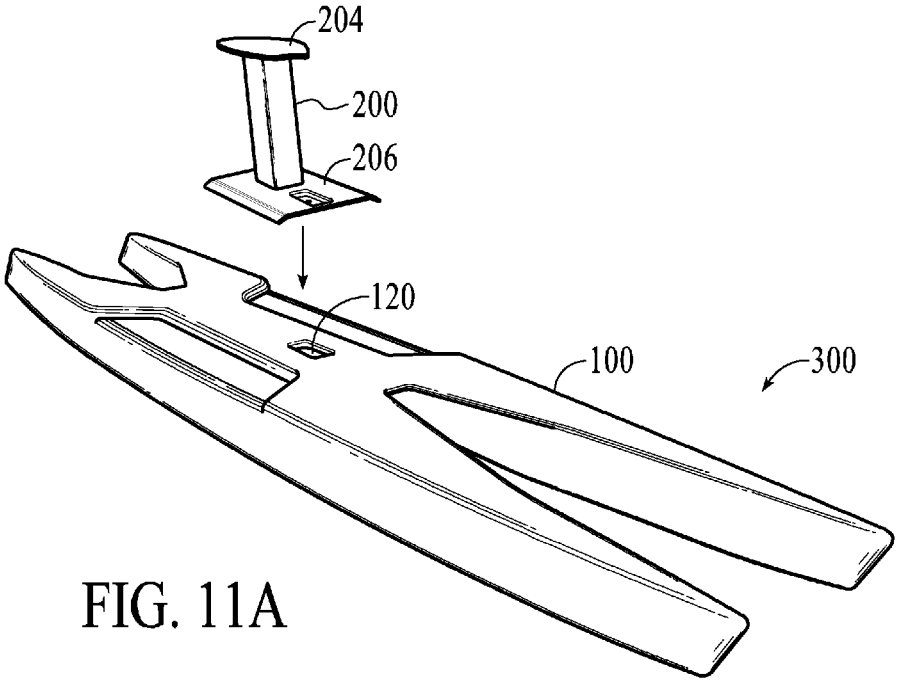
FIGS. 11A and 11B are representative upper isometric views of the paddle board 100 with removable seat 300 of the present invention.
Figure 11B:
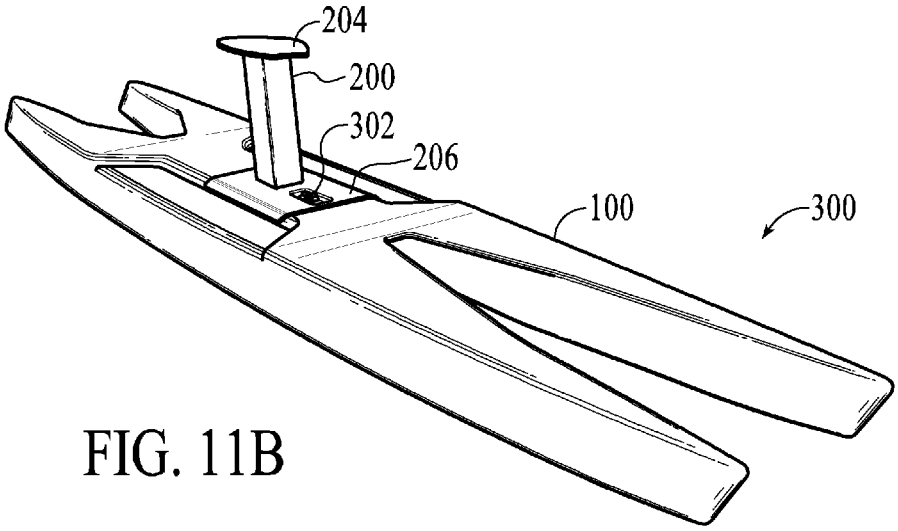

FIGS. 11A and 11B are representative upper isometric views of the paddle board with removable seat 300 of the present invention. As shown in FIGS. 11A and 11B, paddle board with removable seat 300 consists mainly of the paddle board 100 or alternative embodiment of the paddle board 150 and seat portion 200. In one embodiment, seat portion 200 is simply placed upon paddle board 100 in a centrally balanced area over the deck opening 120. Seat portion 200 can be fixed or connected or not fixed or connected. In certain embodiments, the seat portion 200 is constructed integrally with the SUP board 100 and is not removable. The method of connection of the seat portion 200 of the present invention to the SUP board 100 can be mechanical or otherwise. Seat portion 200 can be made of many different materials as long as they are structurally capable of serving the intended function of supporting a user's body weight, safe to use for users and accessories including clothing and otherwise free from sharp or rough edges, ergonomically or otherwise shaped for efficient use thereof, waterproof, etc. In one embodiment, molded plastic or fiberglass with a foam core make very good building materials for seat portion 200. Other materials include wood, extruded or cast metals, plastics or composites, etc.

Figure 11C:
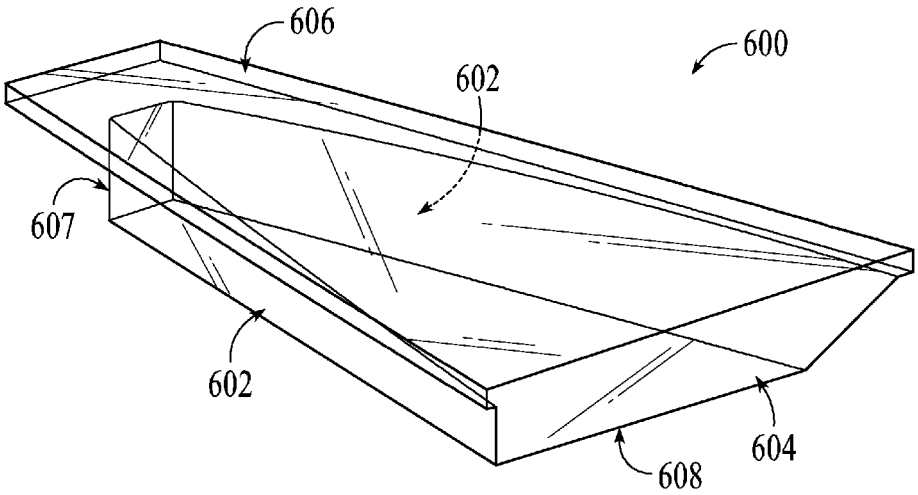
FIG. 11C is a representative isometric view of one embodiment of viewing port 600 of the paddle board 100 of the present invention.
Figure 11D:
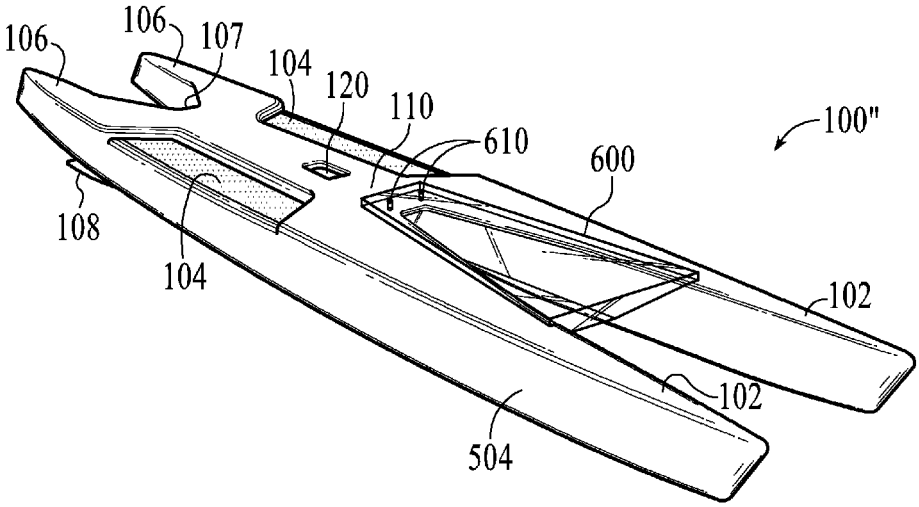
FIGS. 11D and 11E are representative upper isometric views of the paddle board 100 with optional viewing port 600.
Figure 11E:
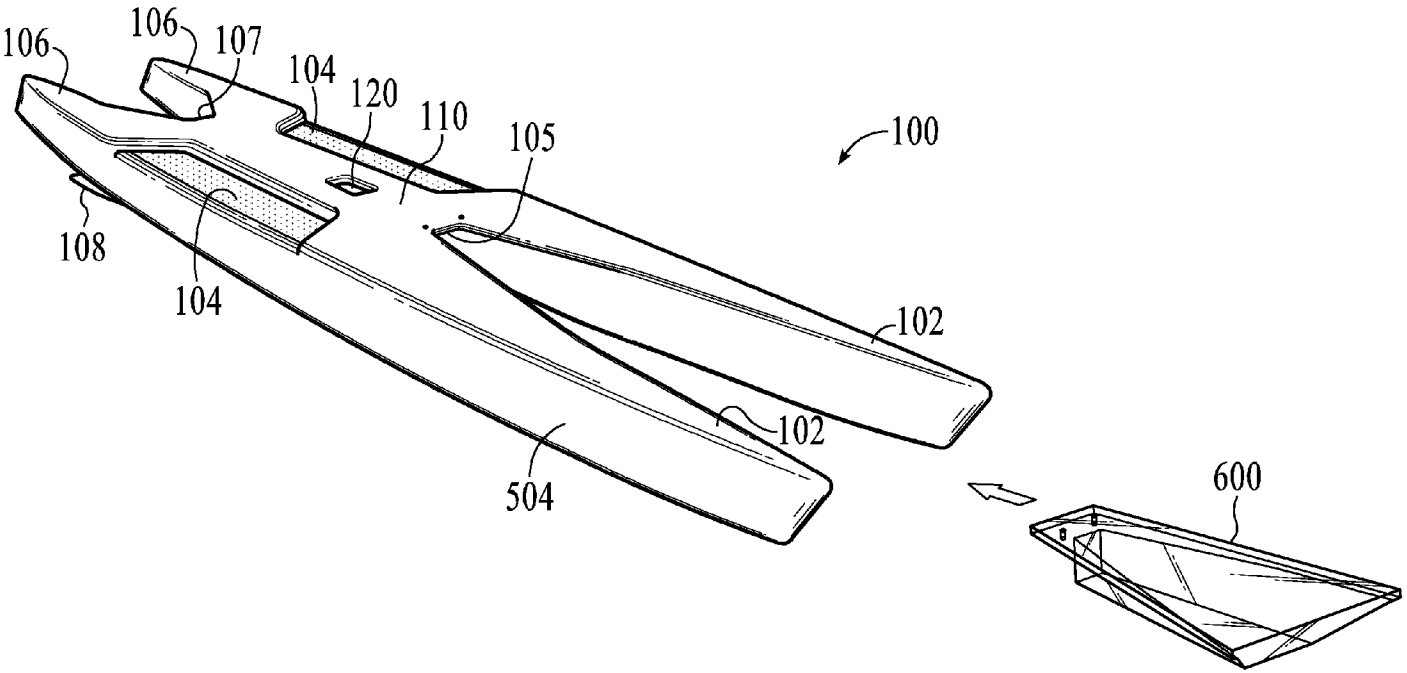

FIG. 11C is a representative isometric view of one embodiment of viewing port 600 of the paddle board 100" of the present invention. The viewing port 600 allows users to see under the water as one would in a regular glass bottom boat. In one embodiment, viewing port 600 is an attached and removable underwater viewing port, consisting of a horizontal clear flat top portion 606 and a horizontal clear flat bottom portion 608. Between the top and bottom portions 606 and 608, there are a sloping clear flat forward portion 604, which subsequently connected to two vertical flat side portions 602 on its left and right sides. The side portions 602 can be clear or unclear and they are connected by one rear flat vertical portion 607, which can be clear or non-clear. FIGS. 11D and 11E are representative upper isometric views of the paddle board 100" with optional viewing port 600. A viewing port 600 can optionally be coupled to the top of the deck 110 attached in between hulls 102 of the reverse V deck as best shown in FIGS. 11D and 11E. The viewing port 600 can be attached using temporary clips or snaps or other mechanical coupling mechanism 610 as would be known to those skilled in the art. The purpose of the viewing port 600 it to provide viewing of underwater scenery as well as for seeing the bottom of the body of water in which the paddle board 100 is being used, similar to the experience of being in a glass bottom boat. In one embodiment, clear flat bottom portion 608 should sit at water level or several inches below the surface, or even be at the level of and adjacent to the lower surfaces 510 of the hulls of the SUP board 100" of the present invention.

Figure 12A:
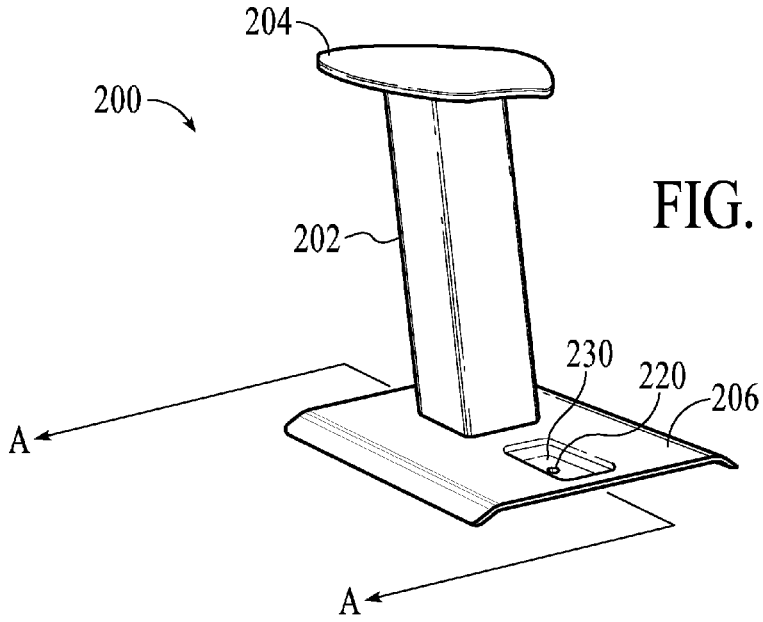
FIGS. 12A, 12B and 12C are a representative upper isometric view, cross-sectional view and upper isometric view of the assembly of removable seat portion 200 of the present invention, respectively.
Figure 12B:
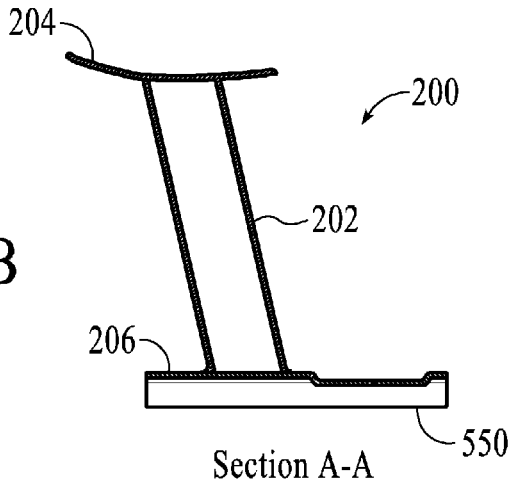
Figure 12C:
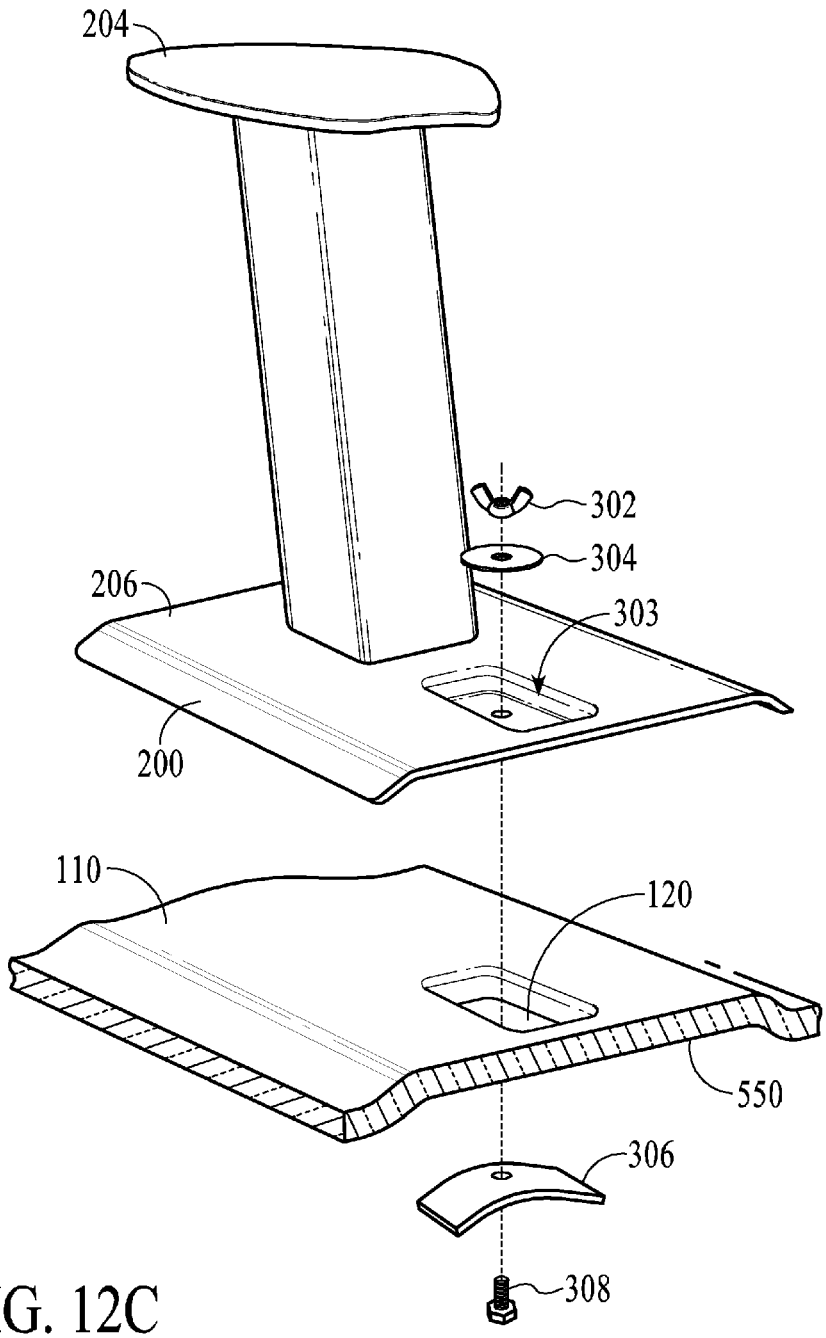

FIGS. 12A, 12B and 12C are representative upper isometric view, cross-sectional view and upper isometric view of assembly of removable seat portion 200 of the present invention. In one embodiment, seat portion 200 further consists of flat seat top 204 for paddlers to sit down or lean against while paddling or resting; leg 202 and bottom plate 206. In one embodiment, recessed counter sunk portion 303 of bottom plate 206 rides over deck 110 at deck opening 120. As best shown in FIG. 12C, mechanical means such as a bolt 308 passes through the bottom plate 206 which sits flush on top of the upper deck 110, then through the deck opening 120, and then through a flat plate 306 on the underside 550 of the deck 110. The flat plate 306, being larger than the deck opening 120, secured the seat when a wing nut 302 along with a washer 304 is screwed onto the bolt 308 from the underside 550 of the deck 110. In one embodiment, seat portion 200 is adjustably fastened onto paddle board 100 such that it can be adjusted up or down, or forward or backward, to alter the location of the seat portion 204 according to the preference of the paddler or the water conditions present.

In a preferred embodiment (not shown), the coupling mechanism for coupling the removable seat to the flat platform 110 between the two hulls is integral with the seat itself. A quick release or locking single-turn clamp mechanism can comprise an assembly with lower plate, upper flange portion and tightening pin which can be assembled, tightened and locked together in place without having removable parts.

As best shown in FIG. 12C, the leg 202 of seat portion 200 is preferably hollow or extruded to reduce the weight of the overall paddle board 300.

In another embodiment, seat portion 200 can be used on other watercraft such as canoes kayaks, or just to sit on the beach. This removable seat structure can be adapted to any paddle board including the traditional surfboard styles.

Figure 13A:
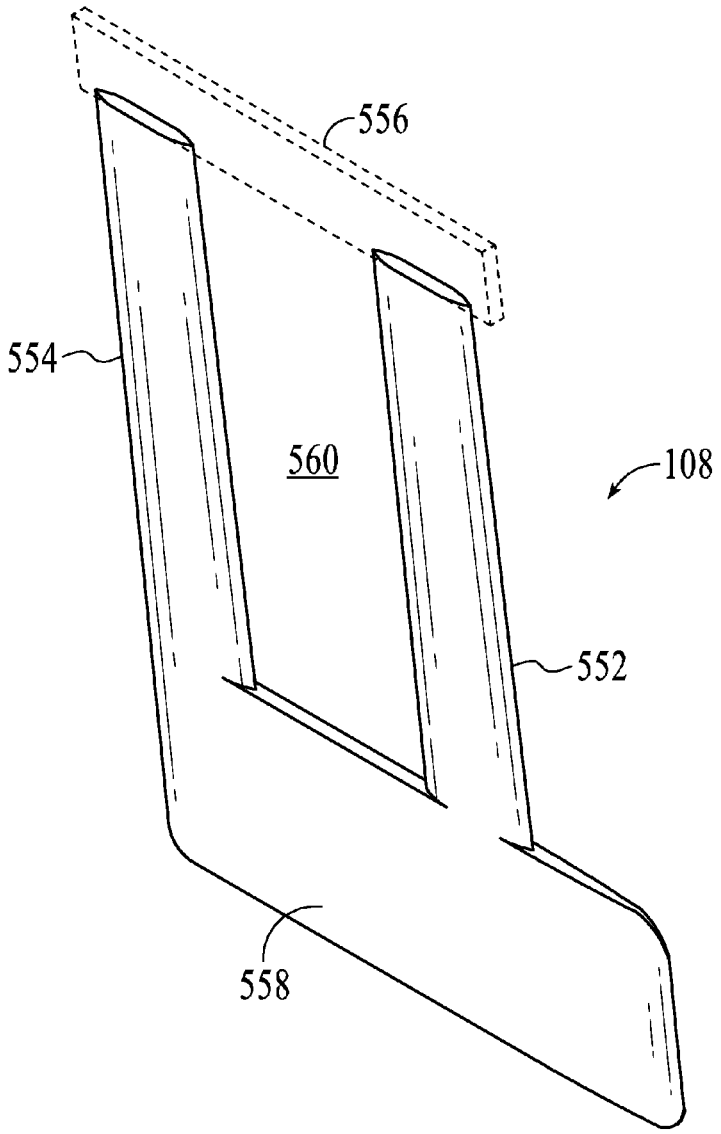
FIG. 13A shows an optional fin 108 of the present invention.
Figure 13B:
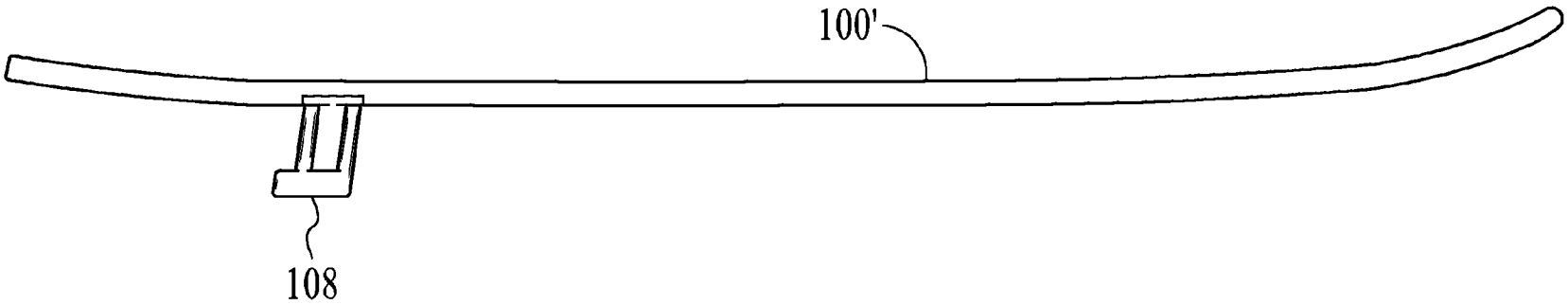
FIG. 13B is a representative side view of the fin 108 coupled to the lower surface 510 of SUP board 100' of the present invention.

FIG. 13A shows an optional fin 108 of the present invention. FIG. 13B is a representative side view of the fin 108 coupled to the lower surface 510 of SUP board 100' of the present invention. As shown, fin 108 comprises a leading edge 554, a trailing edge 552, and an upper portion 556 for connecting to the lower surface 510 of the hulls 102. In addition, a portion of material is removed from the upper and center portion of the fin 108 leaving an open section 560 and the lower portion 558 is enlarged compared with many boat and board fins and a center open section 560. This unique, open shape of fin 108 provides greater stability compared with conventional solid body fins having the same cross-sectional area. In other words, by using the same amount of overall material, a fin design 108 comprising the open section 560 will provide a fin 108 having enhanced stability.

The main purpose of fin 108 is to increase stability of the paddle board. Stability is increased by prevention of rolling from side to side. Stability is also increased by achievement of improved tracking, i.e., by prevention of turning out of a directly forward motion or spinning, such as may be caused by paddling on only one side, currents, by surface winds coming from one side, etc. In one embodiment, fins 108 are installed on the tail ends 106 of both hulls 102 of the paddle board 100 or alternate embodiment of paddle board 100' of the present invention. The objective of fin 108 is to increase stability and tracking performance of SUP board 100'. This is achieved by increasing surface area at the lower portion 558 which is deeper in the water and therefore more effective. By leaving an open area in the upper and center portions 560 and adding area to the lower portion 558 achieves this goal without increasing the total surface area which would cause extra drag through the water.

Figure 14A:
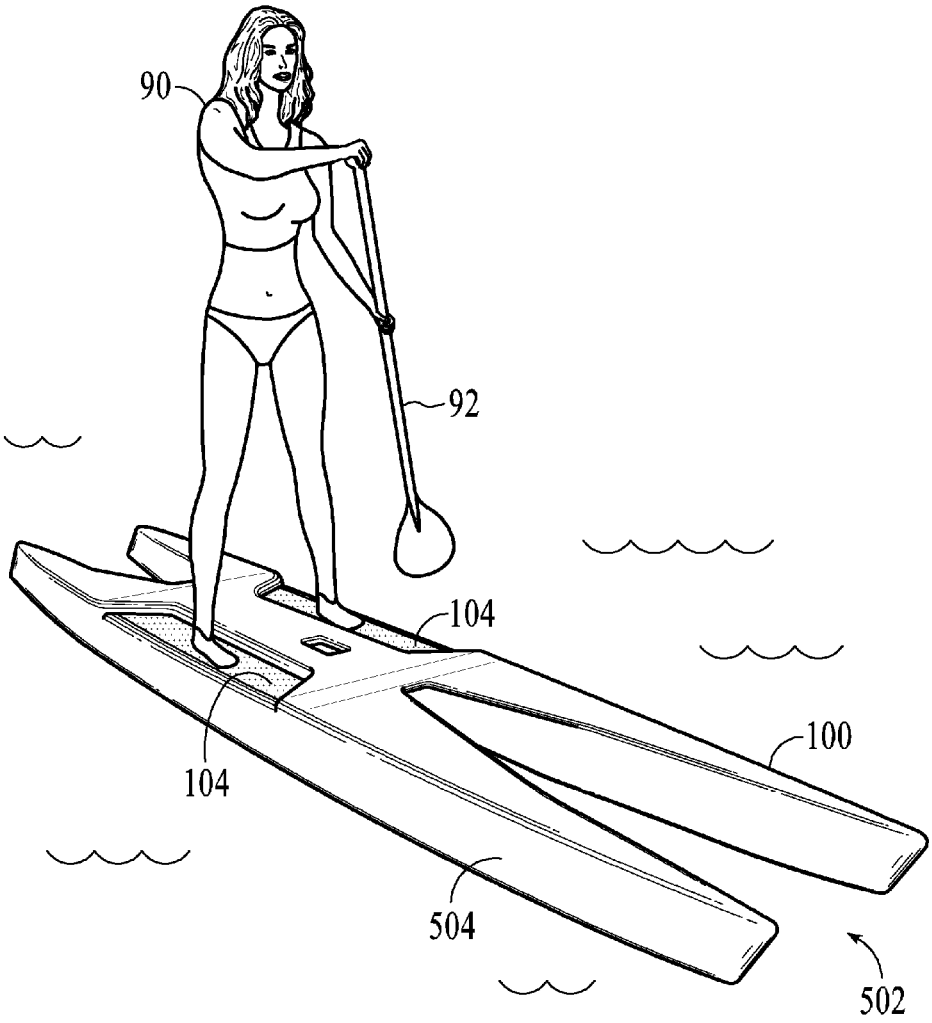
FIGS. 14A and 14B shows representative methods of use of the paddle board with removable seat 300 of the present invention.
Figure 14B:
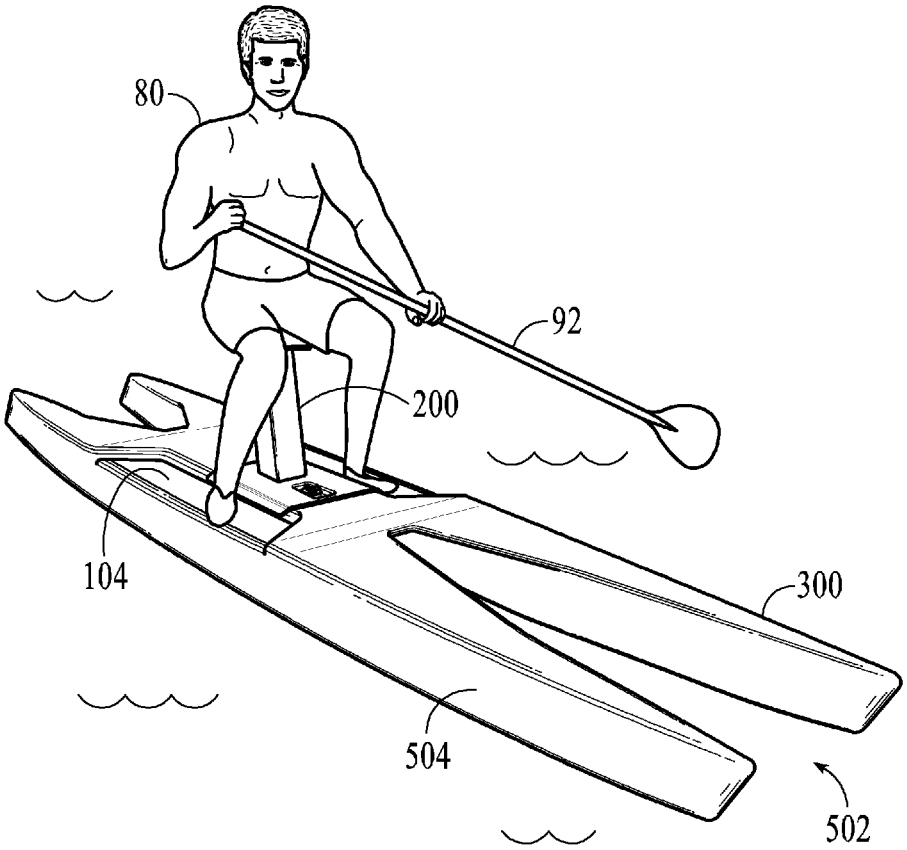

FIGS. 14A and 14B shows representative methods of use of the paddle board with removable seat 300 of the present invention in two different modes. As best shown in FIG. 14A, paddler 90 has detached and removed seat portion (not shown) from the paddle board 100. Her feet are securely placed within foot wells 104 for security and a lower center of gravity. As best shown in FIG. 14B, paddler 80 decided to attach seat portion 200 to paddle board 100. The attached seat portion 200 enables paddler 80 to sit down and paddle the SUP board 100 simultaneously.

Unless defined otherwise, all technical and scientific terms used herein have the same meaning as commonly understood by one of ordinary skill in the art to which the present invention belongs. Although any methods and materials similar or equivalent to those described can be used in the practice or testing of the present invention, the preferred methods and materials are now described. All publications and patent documents referenced in the present invention are incorporated herein by reference.

While the principles of the invention have been made clear in illustrative embodiments, there will be immediately obvious to those skilled in the art many modifications of structure, arrangement, proportions, the elements, materials, and components used in the practice of the invention, and otherwise, which are particularly adapted to specific environments and operative requirements without departing from those principles. The appended claims are intended to cover and embrace any and all such modifications, with the limits only of the true purview, spirit and scope of the invention.

I claim:

1. A twin-hull stand up paddle board, the twin-hull paddle board comprising:

two elongated hulls, the hulls contoured to have top surfaces, pointed front ends and pointed back ends, the two hulls positioned parallel to each other; and a flat platform portion having two side edges, a front edge and a back edge, the platform portion connected across the top of the two hulls intermediate between the front ends and the back ends of each hull, the flat platform portion and the tops of the hulls forming an upper deck portion, the upper deck portion and the top surfaces of the elongated hulls having a very low profile such that the distance between the upper deck portion and the top surfaces of the elongated hulls and the surface of the water is minimized, thereby decreasing resistance to wind against the twin-hull paddle board, the upper deck portion comprising two recessed foot wells placed adjacent to the side edges of the flat platform portion, the recessed foot wells contoured to prevent accumulation or puddling of water during use, the upper deck portion further having a lower surface which stays above the surface of the water, the upper deck portion further having a deep-V shape at the front edge of the platform area and a deep-V shape at the back edge of the platform portion, whereby instability of the twin-hull stand up paddle board caused by waves and front wake is eliminated.

2. The twin-hull paddle board of claim 1, wherein the top surfaces of the hulls have a side-to-side cross section profile selected from the group of shapes consisting of flat, curved, bell, arched, and V-shaped.

3. The twin-hull paddle board of claim 1 in which each of two hulls further comprise a rear fin, thereby increasing stability of the paddle board.

4. The twin-hull paddle board of claim 3 in which each of the rear fins has an upper portion in which a section of material has been removed and an enlarged lower portion which provides increased stability compared with a conventional, solid fin.

5. The twin-hull paddle board of claim 1 in which the removable seat further comprises a lower plate portion and the coupling mechanism couples the lower plate portion to the flat platform portion.

6. The twin-hull paddle board of claim 1 further comprising a viewing window portion attached to the front edge of the flat platform portion by mechanical means, the viewing window portion further comprising a top panel and a bottom panel, at least the bottom panel made of transparent material, four side panels positioned between the top and bottom panels, four side panels further assembled to a shape fitted snugly to the front panel of the flat platform portion.

7. The twin-hull paddle board of claim 6 in which one or more side panels of the viewing window portion are constructed with transparent materials.

8. The twin-hull paddle board of claim 3 in which each of the rear fins has a center portion in which a section of material has been removed and an enlarged lower portion which provides increased stability compared with a conventional, solid fin.

9. The twin-hull paddle board of claim 1 wherein the deep-V shaped front edge of the upper deck portion begins at a point about 20% of the length of the paddle board from the front ends of the hull portions and extends rearward to a point about 37.5% of the length of the paddle board from the front ends.

10. The twin-hull paddle board of claim 1 wherein the upper deck portion further comprises an opening placed centrally in the flat platform portion.

11. The twin-hull paddle board of claim 1, further comprising a removable seat comprising a flat seat top integrally connected to a leg portion, wherein the stand up paddle board of the present invention can be used for stand up paddling as well as paddling while seated on the removable seat.

12. The twin-hull paddle board of claim 11 further comprising a coupling mechanism for removably coupling the leg portion of the removable seat to the upper deck portion of the paddle board.

* * * * *